US008744280B1

(12) United States Patent
Poppenga

(10) Patent No.: US 8,744,280 B1
(45) Date of Patent: Jun. 3, 2014

(54) METHOD AND APPARATUS FOR DETECTING AN UNSAFE OPERATING CONDITION IN AN AUTOMATIC DOCUMENT FEEDER

(75) Inventor: Burt Poppenga, Eagle, ID (US)

(73) Assignee: Marvell International Ltd., Hamilton (BM)

( * ) Notice: Subject to any disclaimer, the term of this patent is extended or adjusted under 35 U.S.C. 154(b) by 234 days.

(21) Appl. No.: 13/154,162

(22) Filed: Jun. 6, 2011

Related U.S. Application Data

(60) Provisional application No. 61/357,856, filed on Jun. 23, 2010.

(51) Int. Cl.
*G03G 15/00* (2006.01)

(52) U.S. Cl.
USPC ..... 399/9; 399/12; 399/16; 271/258.01

(58) Field of Classification Search
USPC ..... 399/9, 12, 16; 271/258.01
See application file for complete search history.

(56) References Cited

U.S. PATENT DOCUMENTS 7,954,812 B2 * 6/2011 Shimmachi et al. ..... 271/264

FOREIGN PATENT DOCUMENTS

JP 03069967 A * 3/1991

* cited by examiner

*Primary Examiner* — Luis A Gonzalez

(57) ABSTRACT

Embodiments of the present disclosure provide a method comprising loading a medium onto an input tray of a imaging device; staging the medium within the imaging device, wherein staging the medium includes moving the medium from the input tray to a staging area within the imaging device; during the staging of the medium, determining an average load current of a motor that is associated with an automatic document feeder of the imaging device; and based on the average load current, determining a threshold load current of the motor, wherein the threshold load current corresponds to the panel of the imaging device having been opened.

19 Claims, 2 Drawing Sheets

METHOD AND APPARATUS FOR DETECTING AN UNSAFE OPERATING CONDITION IN AN AUTOMATIC DOCUMENT FEEDER

CROSS REFERENCE TO RELATED APPLICATIONS

The present application claims priority to U.S. Patent Application No. 61/357,856, filed Jun. 23, 2010, the entire specification of which is hereby incorporated by reference in its entirety for all purposes, except for those sections, if any, that are inconsistent with this specification.

TECHNICAL FIELD

Embodiments of the present disclosure relate to the field of automatic document feeders, and more particularly, to methods and apparatus for detecting an unsafe operating condition in an automatic document feeder.

BACKGROUND

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

An imaging device (e.g., a printer, a scanner, a copier, etc.) typically includes an automatic document feeder that automatically feeds media—e.g., one or more papers—loaded onto a paper feed tray into the imaging device. An automatic document feeder generally includes several moving components, e.g., gears, shafts, rollers, etc., for feeding a medium into an imaging device. During operation, an automatic document feeder may jam—e.g., a paper being automatically fed into the imaging device may become stuck due to misalignment.

Accordingly, conventional imaging devices typically include i) a panel that can be opened by a user, e.g., to remove a paper that has jammed, as well as ii) a sensor to sense whether such panel is opened or closed. If a panel of an imaging device is opened during the general operation of the imaging device, an automatic document feeder of the imaging device halts operation based on the sensor having sensed that the panel has been opened. The operation of the automatic document feeder is generally halted to prevent a user from accessing (and potentially being harmed by) the components of the automatic document feeder that would have otherwise been moving through the opened panel.

SUMMARY

In accordance with various embodiments of the present disclosure, there is provided a method for determining whether a panel of an imaging device has been opened, wherein the imaging device includes (i) an input tray onto which a medium is loadable, and (ii) an automatic document feeder configured to stage the medium from the input tray to a staging area within the imaging device, the method comprising: loading the medium onto the input tray of the imaging device; staging the medium within the imaging device, wherein staging the medium includes moving the medium from the input tray to the staging area within the imaging device; during the staging of the medium, determining an average load current of a motor that is associated with the automatic document feeder; and based on the average load current, determining a threshold load current of the motor, wherein the threshold load current corresponds to the panel of the imaging device having been opened.

In various embodiments, there is also provided an imaging device comprising a motor; an input tray on which a medium is loadable; an automatic document feeder including a roller that is configured to stage the medium from the input tray to a staging area within the imaging device, wherein the roller is driven by the motor; a motor load sensing module configured to estimate, during staging of the medium, an average load current of the motor; and a threshold load current determination module configured to determine a threshold load current of the motor based on the average load current, wherein the threshold load current is associated with a panel of the imaging device having been opened.

In various embodiments, there is also provided a method for operating an automatic document feeder, the method comprising: operating the automatic document feeder in (i) a first stage and (ii) a second stage that occurs subsequent to the first stage; and while operating in the first stage, determining a threshold load current of a motor associated with the automatic document feeder, wherein the threshold load current is associated with a panel open event of the automatic document feeder.

BRIEF DESCRIPTION OF THE DRAWINGS

Embodiments of the present disclosure will be readily understood by the following detailed description in conjunction with the accompanying drawings. To facilitate this description, like reference numerals designate like structural elements. Embodiments of the disclosure are illustrated by way of example and not by way of limitation in the figures of the accompanying drawings.

DETAILED DESCRIPTION OF EMBODIMENTS OF THE DISCLOSURE

The description below includes use of perspective-based descriptions such as bottom. Such descriptions are merely used to facilitate the discussion and are not intended to restrict the application of embodiments of the present disclosure.

Figure 1:
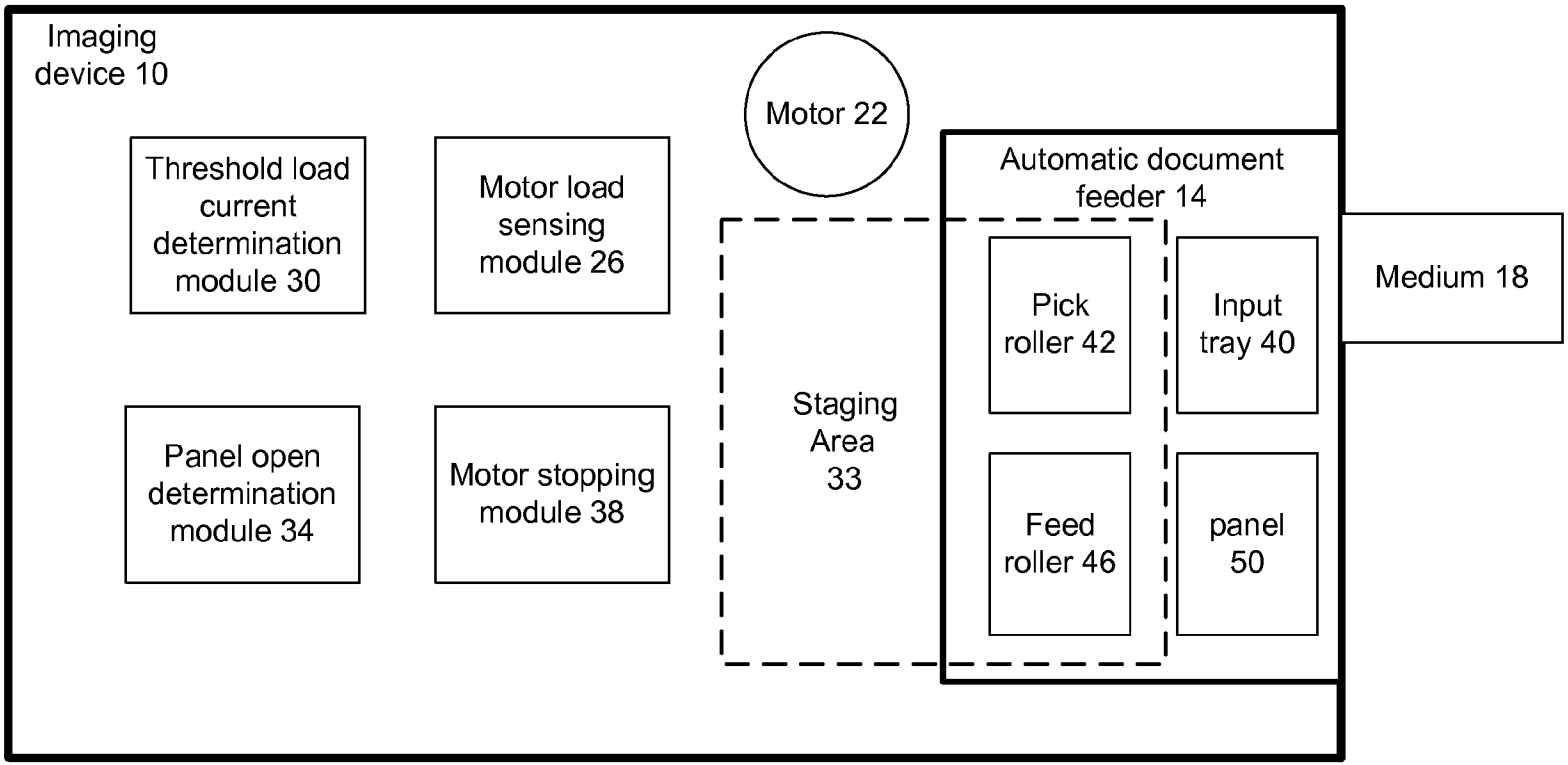
FIG. 1 schematically illustrates an imaging device that includes an automatic document feeder, in accordance with various embodiments of the present disclosure.

FIG. 1 schematically illustrates an imaging device 10 that includes an automatic document feeder 14, in accordance with various embodiments of the present disclosure. In various embodiments, the imaging device 10 can be any appropriate imaging device that intakes a medium 18 and performs some type of image processing operation on the medium 18. For example, the imaging device 10 may be a printing device, a scanning device, a copying device, a fax machine, a multifunction printer (MFP, which can, for example, print, scan, copy and/or fax), or the like. The medium 18 can be, for example, one or more papers, fabric, etc. on which, for example, the imaging device 10 prints one or more images (e.g., if the imaging device 10 is a printing device). In another example, the medium 18 can be a paper that includes an image, and the imaging device 10 scans, copies and/or faxes the image from the paper.

The automatic document feeder 14 includes an input tray 40 on which the medium 18 is placed. In an example, the medium 18 comprises a plurality of papers loaded on the input tray 40, and the automatic document feeder 14 feeds one paper at a time in the imaging device 10 from the input tray 40. The imaging device 10, for example, prints on the paper(s), scans the paper(s), faxes the paper(s), and/or copies the paper (s) that are fed in the imaging device 10 from the input tray 40.

The automatic document feeder 14 includes various components used for moving the medium 18 through the imaging device 10. For example, the automatic document feeder 14 includes a pick roller 42 and a feed roller 46. The imaging device 10 also includes a motor 22 that drives the pick roller 42, the feed roller 46 and one or more other components of the automatic document feeder 14 (although in various embodiments, more than one motor can drive various components of the automatic document feeder 14). Although illustrated to be separate from the automatic document feeder 14 in FIG. 1, in various other embodiments, the motor 22 is a part of the automatic document feeder 14.

When the medium 18 is to be fed in the imaging device 10, the pick roller 42 picks the medium 18 from the input tray 40 and moves the medium 18 from the input tray to a staging area 33 in the imaging device 10 (e.g., the pick roller 42 stages the medium 18 in the staging area 33). In one implementation, the staging area 33 corresponds to a location in which the medium is immediately adjacent to an area of the imaging device 10 in which the medium is to be scanned or processed by the imaging device 10. The feed roller 46 receives the medium 18 in the staging area 33, and moves the medium 18 through the imaging device 10.

For example, if the imaging device 10 is a scanner and the medium 18 is a paper, the pick roller 42 initially picks the paper from the input tray 40 and stages the paper to a position in the imaging device 10 (e.g., to a scan bar in the imaging device 10) from which the scan is to be started (e.g., stages the paper in the staging area 33). The feed roller 46 then moves the paper from the staging area 33, through the imaging device 10, while the paper is being scanned by the imaging device 10. On the completion of the scanning operation, the paper is expelled from the imaging device 10.

Although the automatic document feeder 14 includes several other components (e.g., components that move during an operation of the automatic document feeder 14, e.g., one or more gears, shafts, rollers, etc.), these are not illustrated in FIG. 1 for the purpose of illustrative clarity. Various components of the automatic document feeder 14 that moves during a general operation of the automatic document feeder 14 (e.g., while the automatic document feeder 14 is feeding medium 18 to the imaging device 10), including the pick roller 42 and the feed roller 46, are also referred to herein as the moving components of the automatic document feeder 14.

The automatic document feeder 14 further includes a panel 50, which, during the general operation of the imaging device 10, prevents access to one or more moving components of the automatic document feeder 14. The panel 50 of the automatic document feeder 14 can be opened, for example, to remove a jammed paper in the imaging device 10. In various embodiments, the automatic document feeder 14 does not include a sensor (e.g., an optoelectronic sensor) to sense whether the panel 50 is opened or closed.

The imaging device 10 also includes a motor load sensing module 26, a threshold load current determination module 30, a panel open determination module 34, and a motor stopping module 38, as will be discussed in more detail herein later. Although illustrated to be separate from the automatic document feeder 14 in FIG. 1, in various other embodiments, the motor load sensing module 26, the threshold load current determination module 30, the panel open determination module 34 and/or the motor stopping module 38 are part of the automatic document feeder 14.

During the general operation of the imaging device 10, as the medium 18 moves through the imaging device 10, the load of the motor 22 (and accordingly, the load current of the motor 22) varies considerably. For example, when the pick roller 42 initially picks the medium 18, the load of the motor 22 suddenly increases. In another example, when a trailing edge of the medium 18 passes over the pick roller 42, there is a sudden dip in the load of the motor 22. In yet another example, if the imaging device 10 is a printer, while printing relatively dark area on the medium 18, the medium 18 progresses relatively slowly. On the other hand, while printing white area on the medium 18, the medium 18 progresses relatively fast. Such different speeds of the medium 18 also result in load variations in the motor 22. In yet another example, when the motor 22 starts, the load generally increases momentarily due to, for example, initial inertia, gear train wind-up, velocity overshoot, etc.

In addition to the variation of the load of the motor 22 due to the movement of the medium 18 through the imaging device 10, the load of the motor 22 also depends of various other factors. For example, the load of the motor 22 depends on a type of the medium 18 (e.g., a relatively thick and/or heavy paper, used as the medium 18, results in relatively large load compared to a relatively thin and/or light paper), a temperature and/or humidity in which the imaging device 10 is operating, age of the imaging device 10 (e.g., the load can vary as the imaging device 10 ages), and/or the like. In another example, the load current of the motor 22 is based on a terminal resistance of the motor 22 (e.g., which changes with temperature and the age of the motor 22). Thus, the load current of the motor 22 is based on various operating parameters of the imaging device 10 (e.g., the type of the medium 18, operating conditions (e.g., temperature, humidity, etc.) of the imaging device 10, age, type, configuration and/or properties of the motor 22, etc.).

In various embodiments, if the panel 50 is opened during the general operation of the automatic document feeder 14, one or more moving components of the automatic document feeder 14 gets disengaged or disconnected from the motor 22. Accordingly, the load of the motor 22 suddenly decreases when the panel 50 is opened during the general operation of the imaging device 10. In various embodiments, the imaging device 10 uses this phenomena to sense a panel open event and stop the motor 22 (e.g., to prevent accidental contact of a user with a moving component of the automatic document feeder 14), as will be discussed in more detail herein later.

For example, during a first operation of the imaging device 10 (e.g., while feeding a first page of the medium 18), the load current of the motor 22 decreases to, for example, I1 when the panel 50 is opened. In another example, during a second operation of the imaging device 10 (e.g., while feeding a second page of the medium 18), the load current of the motor 22 decreases to, for example, I2 when the panel 50 is opened. However, as the load of the motor 22 varies considerably based on various factors, in various embodiments, currents I1 and I2 can be different. For example, I1 and I2 can depend on a thickness and weight of the first and second pages, temperature, humidity and age of the imaging device 10 during the first operation and the second operation, make and model of the imaging device 10, terminal resistances of the motor 22, etc. (i.e., I1 and I2 depend on various operating parameters of the imaging device 10 during the first and second operations of the imaging device 10). Accordingly, it may be difficult to come up with a fixed load current value, such that if the load current of the motor 22 decreases below the fixed load current value during operations of the imaging device 10, a panel open event (e.g., an event which indicates that the panel 50 is opened) is correctly detected.

Figure 2:
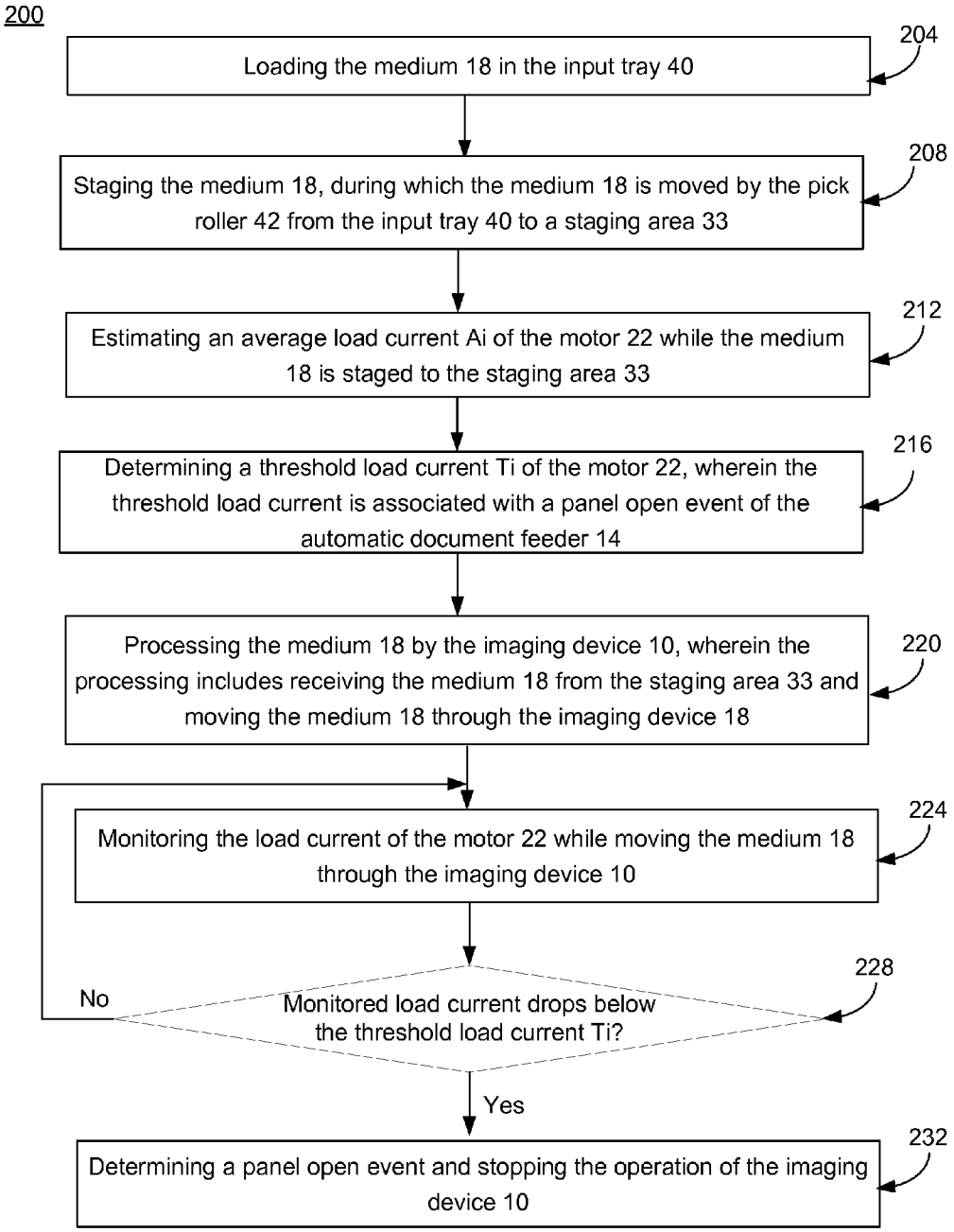
FIG. 2 is a flowchart describing a method for operating the automatic document feeder of FIG. 1, in accordance with various embodiments of the present disclosure.

FIG. 2 is a flowchart describing a method 200 for operating the automatic document feeder 14 of FIG. 1, in accordance with various embodiments of the present disclosure. Referring to FIGS. 1 and 2, at 204, the medium 18 (e.g., a paper) is loaded in the input tray 40 of the automatic document feeder 14. At 208, the automatic document feeder 14 stages the medium 18, during which the medium 18 is moved by the pick roller 42 from the input tray 40 to the staging area 33 of the imaging device 10. The medium 18 is staged when, for example, the medium 18 is to be fed in the imaging device 10.

At 212, the motor load sensing module 26 estimates an average load current Ai of the motor 22 while the medium 18 is staged to the staging area 33 (e.g., during the staging operation of the medium 18). For example, the motor load sensing module 26 senses (e.g., measures) the load current of the motor 22 in real time while the automatic document feeder 14 stages the medium 18, and motor load sensing module 26 estimates the average load current Ai based on sensing the load current. In various other embodiments, the load sensing module 26 estimates the average load current Ai of the motor 22 during the staging operation based on, for example, duration of time the motor 22 operates during the staging operation, an average voltage applied to the motor 22 during the staging operation, etc.

In various embodiments, while estimating the average load current Ai at 212, the motor load sensing module 26 uses a rolling window of configurable time length. As an example, the staging operation of the medium 18 takes about 5 seconds to complete, and the configurable time length is about 4 seconds. Thus, at the end of the staging operation, the load current during the last 4 seconds are used to determine the average load current Ai at 212. Accordingly, the load current during the initial 1 ms of the staging operation is ignored while determining the average load current Ai at 212. In various embodiments, the load current at the start of the staging operation (i.e., the initial load current) is ignored while estimating the average load current Ai, as the initial load current can vary considerably due to, for example, winding up of the gear train mechanism in the automatic document feeder 14, slipping of one or more moving components of the automatic document feeder 14 at the start up of the motor 22, etc. In an embodiment, the load current during the time length is sampled periodically (e.g., every 2 milliseconds), and these samples are used to determine the average load current.

Referring again to FIGS. 1 and 2, at 216, the threshold load current determination module 30 determines a threshold load current Ti of the motor 22, where the threshold load current Ti is associated with a panel open event of the automatic document feeder 14. In various embodiments, the threshold load current Ti is based on the average load current Ai and also on various parameters associated with the imaging device 10 (e.g., associated with the motor 22), as will be discussed in more detail herein later.

At 220, the imaging device 10 process the medium 18, e.g., receives the medium 18 from the staging area 33, moves the medium 18 through the imaging device 10, and performs one or more image processing operations on the medium 18 (e.g., prints on the medium 18, copies an image from the medium 18, scans the image from the medium 18, faxes the image from the medium 18, and/or the like).

While processing the medium 18 (e.g., while moving the medium 18 from the staging area 33 through a remaining portion of the imaging device 10), at 224 the motor load sensing module 26 monitors the load current of the motor 22. Thus, the operations at 220 and 224 at least in part overlap.

At 228, the panel open determination module 34 determines if the monitored load current drops below the threshold load current Ti during the movement of the medium 18 through the imaging device 10. If the monitored load current does not drop below the threshold load current Ti, the motor load sensing module 26 continues the monitoring at 224 until the medium 18 completes its movement through the imaging device 10 (e.g., until the imaging device 10 completes its image processing operation of the medium 18 and expels the medium 18 from the imaging device 10).

However, if the monitored load current drops below the threshold load current Ti during any time the medium 18 is moving through the imaging device 10, at 232 the panel open determination module 34 determines a panel open event (i.e., determines that the panel 50 has been opened during the movement of the medium 18 through the imaging device 10), and the motor stopping module 38 immediately stops the motor 22 (e.g., so that the moving components the automatic document feeder 14 stops moving), e.g., to prevent a user from accidentally accessing the moving components of the automatic document feeder 14 through the opened panel 50. Thus, the method 200 enables the imaging device 10 to detect a panel open event, without needing a dedicated sensor to detect such an event.

Referring again to 216 of the method 200, the threshold load current determination module 30 can determine the threshold load current Ti of the motor 22 using a variety of ways. In various embodiments, the threshold load current Ti is set to be a percentage Pi (where the percentage Pi can be configurable or tunable) of the average load current Ai.

In various embodiments, the average load current Ai is based on, for example, the medium 18 (e.g., based on a thickness and/or a weight of the medium 18), operating conditions of the imaging device 10 (e.g., a temperature and/or humidity at which the imaging device 10 operates), an age, type, configuration and/or properties of the motor 22, etc. As the average load current Ai is estimated each time the medium 18 is fed by the automatic document feeder 14, the threshold load current Ti is dynamically determined each time the medium 18 is fed by the automatic document feeder 14. The threshold load current Ti dynamically adapts to various operating parameters (e.g., the type of the medium 18, the operating conditions of the imaging device 10, the age, type, configuration and/or properties of the motor 22, etc.) of the imaging device 10. Also, as the load current during a panel open event is based on one or more of these operating parameters, dynamically determining the threshold load current Ti at 216 helps in relatively more accurate determination of the panel open event at 232 of the method 200.

As an example, during a first general operation of the imaging device 10 (e.g., while feeding a first medium 18*a*), an average load current Ai1 and a threshold load current Ti1 is determined at 212 and 216, respectively. Also, during a second general operation of the imaging device 10 (e.g., while feeding a second medium 18*b*), an average load current Ai2 and a threshold load current Ti2 is determined, respectively. If, for example, the first medium 18*a* is thicker and heavier in weight compared to the second medium 18*b*, then the load current of the motor 22 is higher during a staging operation of the first general operation compared to a staging operation of the second general operation. Accordingly, the average load current Ai1 is higher than the average load current Ai2, and the threshold load current Ti1 is higher than the threshold load current Ti2. Thus, the threshold currents Ti1 and Ti2 dynamically adjust to various operating parameters of the imaging device 10. Also, as a load current associated with a panel open event during the first general operation is relatively higher than that during the second general operation (e.g., due to the difference in the two mediums), dynamically adjusting the threshold load current during the first general operation and the second general operation helps in relatively more accurate determination of the panel open event during the first general operation and the second general, respectively.

In various embodiments and although not illustrated in FIG. 2, instead of estimating the average load current Ai during the staging operation of the automatic document feeder 14, the average load current Ai can be estimated during any other appropriate operation of the automatic document feeder 14 (e.g., while the feed roller 46 picks up the medium 18 from the staging area 33 and starts moving the medium 18).

Instead of estimating the average load current Ai during the staging operation of the medium 18 and subsequently determining the threshold load current Ti, in various other embodiments, pre-defined and configurable average load current Ai and/or threshold load current Ti can be used by the imaging device 10. As an example, each time the imaging device 14 is switched on, the threshold load current Ti is determined, which is used to detect a panel open event for the imaging device 14 while the imaging device 14 operates (e.g., while the imaging device 14 is fed a plurality of pages). This may be done instead of (or in addition to) determining the threshold load current Ti each time a paper is fed in the imaging device 10. In various other embodiments, the threshold load current Ti is set while configuring and/or tuning the imaging device 10, and/or may be a factory set parameter. In various embodiments, the previously discussed percentage Pi can be tuned or configured based on various operating parameters of the imaging device 10.

In various embodiments, a temperature sensor, a humidity sensor, a sensor to measure a type of the medium 18 (e.g., thickness of the medium), etc. can be used to more accurately determine the threshold load current Ti (e.g., to tune the percentage Pi). For example, a history of the threshold load current Ti and the temperature is maintained by the imaging device 10, which is used to determine a current threshold load current Ti based on a current temperature of the imaging device 10.

Various embodiments of this disclosure have been discussed with respect to the automatic document feeder 14 associated with the imaging device 10. However, in various other embodiments, the teachings of this disclosure can be applied to any automatic document feeder (e.g., an automatic document feeder that is not associated with an imaging device), as will be readily understood by those skilled in the art based on the teachings of this disclosure.

As previously discussed, in various embodiments, an average load current of the motor 22 is determined. Based on the average load current, a threshold load current of the motor 22 is determined, wherein the threshold load current corresponds to the panel 50 having been opened. In various other embodiments, this average load current can also be used for various other purposes. For example, another threshold load current can be determined from the determined average load current (where the another threshold load current can be a configurable percentage of the determined average load current). Subsequently, if the monitored load current of the motor 22 while moving the medium exceeds this another threshold current, a jamming condition of the medium in the imaging device 10 can be detected.

In accordance with various embodiments, an article of manufacture may be provided that includes a storage medium having instructions stored thereon that, if executed, result in the operations described herein with respect to FIG. 2. In an embodiment, the storage medium comprises some type of memory (not shown). In accordance with various embodiments, the article of manufacture may be a computer-readable medium such as, for example, software or firmware.

Various operations may have been described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A/B" means A or B. For the purposes of the present disclosure, the phrase "A and/or B" means "(A), (B), or (A and B)." For the purposes of the present disclosure, the phrase "at least one of A, B, and C" means "(A), (B), (C), (A and B), (A and C), (B and C), or (A, B and C)."

The description incorporates use of the phrases "in an embodiment," or "in embodiments," which may each refer to one or more of the same or different embodiments. Furthermore, the terms "comprising," "including," "having," and the like, as used with respect to embodiments of the present disclosure, are synonymous.

As used herein, the term "module" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

Although certain embodiments have been illustrated and described herein, a wide variety of alternate and/or equivalent embodiments or implementations calculated to achieve the same purposes may be substituted for the embodiments illustrated and described without departing from the scope of the present disclosure. This application is intended to cover any adaptations or variations of the embodiments discussed herein. Therefore, it is manifestly intended that embodiments in accordance with the present disclosure be limited only by the claims and the equivalents thereof.

What is claimed is:

1. A method for determining whether a panel of an imaging device has been opened, wherein the imaging device includes (i) an input tray onto which a medium is loaded, (ii) an automatic document feeder configured to stage the medium from the input tray to a staging area within the imaging device, (iii) a motor load sensing module and (iv) a threshold load current determination module, the method comprising:

staging, by the automatic document feeder, the medium within the imaging device, wherein staging the medium includes moving the medium from the input tray to the staging area within the imaging device;

during the staging of the medium, determining, by the motor load sensing module, an average load current of a motor that is associated with the automatic document feeder; and based on the average load current, determining, by the threshold load current determination module, a threshold load current of the motor, wherein the threshold load current corresponds to the panel of the imaging device having been opened.

2. The method of claim 1, further comprising:

in response to staging the medium, processing the medium, by the imaging device, wherein said processing includes receiving the medium from the staging area and moving the medium through the imaging device;

monitoring, by the motor load sensing module, a load current of the motor while moving the medium through the imaging device; and if the monitored load current drops below the threshold load current while moving the medium throughout the imaging device, determining, by a panel open determination module, that the panel of the imaging device has been opened.

3. The method of claim 2, further comprising:

in response to determining that the panel of the imaging device has been opened, discontinuing, by the imaging device, said processing of the medium.

4. The method of claim 2, further comprising:

in response to determining that the panel of the imaging device has been opened, stopping, by a motor stopping module, the motor associated with the automatic document feeder.

5. The method of claim 1, wherein said determining the threshold load current further comprises:

determining the threshold load current such that the threshold load current is a configurable percentage of the average load current.

6. The method of claim 1, wherein said determining the average load current during said staging the medium further comprises:

using a rolling window of time to estimate the average load current.

7. The method of claim 1, wherein said determining the average load current during said staging the medium further comprises:

using a rolling window of time to estimate the average load current such that a load current of the motor at an initiation of said staging the medium is ignored while estimating the average load current.

8. An imaging device comprising:

a motor;

an input tray on which a medium is loadable;

an automatic document feeder including a roller that is configured to stage the medium from the input tray to a staging area within the imaging device, wherein the roller is driven by the motor;

a motor load sensing module configured to estimate, during staging of the medium, an average load current of the motor; and a threshold load current determination module configured to determine a threshold load current of the motor based on the average load current, wherein the threshold load current is associated with a panel of the imaging device having been opened.

9. The imaging device of claim 8, wherein:

the automatic document feeder is further configured to move the medium from the staging area through the imaging device;

the motor load sensing module is further configured to monitor a load current of the motor while the medium is moved from the staging area through the imaging device; and the imaging device further comprises a panel open determination module configured to determine, if the monitored load current drops below the threshold load current while the medium moves from the staging area through the imaging device, that the panel of the imaging device has been opened.

10. The imaging device of claim 9, further comprising a motor stopping module configured to, in response to determining that the panel of the imaging device has been opened, stop the motor.

11. The imaging device of claim 8, wherein the threshold load current is a configurable percentage of the average load current.

12. The imaging device of claim 8, wherein the imaging device is one of a scanning device, a printing device, a copying device, and a faxing device.

13. The imaging device of claim 8, wherein while estimating the average load current of the motor, the motor load sensing module is configured to ignore a load current of the motor at an initiation of staging the medium.

14. A method for operating an automatic document feeder, wherein the automatic document feeder is operated in (i) a first stage and (ii) a second stage that occurs subsequent to the first stage, the method comprising:

while operating in the first stage, determining, by the automatic document feeder, a threshold load current of a motor associated with the automatic document feeder, wherein the threshold load current is associated with a panel open event of the automatic document feeder, and moving, by the automatic document feeder, a paper from an input tray to a staging area of an imaging device; and while operating in the second stage, moving, by the automatic document feeder, the paper from the staging area through the imaging device, and performing, by an imaging device, an image processing operation on the paper.

15. The method of claim 14, further comprising:

while operating in the second stage, monitoring, by a motor load sensing module, a load current of the motor; and if the monitored load current of the motor drops below the threshold load current while operating in the second stage, determining, by a panel open determination module, the panel open event.

16. The method of claim 15, further comprising:

in response to determining the panel open event, stopping the motor by a motor stopping module.

17. A method for operating an automatic document feeder, wherein the automatic document feeder is operated in (i) a first stage and (ii) a second stage that occurs subsequent to the first stage, the method comprising:

while operating in the first stage, determining, by the automatic document feeder, a threshold load current of a motor associated with the automatic document feeder, wherein the threshold load current is associated with a panel open event of the automatic document feeder, wherein determining the threshold load current of the motor associated with the automatic document feeder comprises while operating in the first stage, estimating, by a motor load sensing module, an average load current of the motor associated with the automatic document feeder, and based on the estimated average load current, determining, by a threshold load current determination module, the threshold load current of the motor associated with the automatic document feeder.

18. The imaging device of claim 17, wherein the threshold load current determination module comprises one or more of (i) a temperature sensor, (ii) a humidity sensor, and (iii) a sensor to measure a type of the medium.

19. The method of claim 17, wherein the determining the threshold load current of the motor is based at least in part on a set percentage of the average load current.

* * * * *